United States Patent [19]

Mauney

[11] Patent Number: 4,656,823

[45] Date of Patent: Apr. 14, 1987

[54] SPINDLE TOP

[75] Inventor: Glenn H. Mauney, Sylvania, Ga.

[73] Assignee: BASF Corporation, Williamsburg, Va.

[21] Appl. No.: 876,568

[22] Filed: Jun. 20, 1986

[51] Int. Cl.[4] ..... D01H 7/18; D01H 1/42

[52] U.S. Cl. ..... 57/73; 57/352

[58] Field of Search ..... 57/73, 66, 67, 70, 71, 57/72, 74, 75, 112, 353, 127, 352

[56] References Cited

U.S. PATENT DOCUMENTS

| | | | |
|---|---|---|---|
| 35,145 | 5/1862 | Eaton | 57/73 |
| 2,198,020 | 4/1940 | Weinberger | 57/73 |
| 2,217,371 | 10/1940 | Kowarick | 57/73 |
| 2,622,388 | 12/1952 | Roeder | 57/73 |
| 2,672,007 | 3/1954 | Netelenbos et al. | 57/73 |
| 2,781,627 | 2/1957 | Netelenbos et al. | 57/73 |
| 3,032,960 | 5/1962 | Kartmann | 57/73 |
| 3,104,514 | 9/1964 | Schloesser | 57/73 |
| 3,172,248 | 3/1965 | Piper | 57/73 |
| 3,899,869 | 8/1975 | Easton | 57/73 X |
| 4,307,564 | 12/1981 | Kartmann | 57/73 |

*Primary Examiner*—John Petrakes

*Attorney, Agent, or Firm*—Tom R. Vestal; Rupert B. Hurley, Jr.

[57] ABSTRACT

An improved spindle top having between 3 and 8 fingers together in association with yarn-catching, yarn-directing grooves provides advantages in the manufacture of spun yarns. The improved top reduces ends down by reducing tension upstream of the spindle top, and the improved top is also believed to reduce the amplitude of tension surges which occur as the yarn rolls from one catch point on the spindle top to another.

13 Claims, 6 Drawing Figures

SPINDLE TOP

BACKGROUND OF THE INVENTIOIN

1. Field of the Invention

The present invention pertains to the field of textiles, spinning, twisting and twining. More specifically the present invention is concerned with apparatus and processes for spinning, etc wherein devices in which the receiving element for the strand or filamentary material is rotated or revolved in order to accomplish the twisting. Most specifically, the present invention is concerned with twisting couples in which the tip of the bobbin or spindle is constructed to assist in the twisting operation.

2. Description of the Prior Art

Applicant is aware of several U.S. patents which describe devices which are related to the present invention, including: U.S. Pat. Nos. 3,899,869; 4,307,564; 3,172,248; 3,107,479; 3,141,286; 3,104,514; 2,781,627; 189,890; and 35,145. None of these patents is believed to be close enough to the present invention to warrant a detailed discussion thereof. The present invention differs from this prior art in that the present invention utilizes a multiplicity of physical features which are critically-sized and have critical relative positions with respect to one another.

BRIEF SUMMARY OF THE INVENTION

In the production of spun yarns via the cotton system, the woolen system, or the worsted system, a sliver or roving is formed by carding, etc., and is eventually drawn down to a desired count or weight per unit length. The drafted or drawn roving or sliver is then spun into a yarn on a spinning machine. The spinning machine drafts and twists the sliver or roving in making a spun yarn. The yarn is twisted in the spinning process by directing the yarn onto the uppermost end of a spindle top which is rotating at high speed (between 5500 and 6600 revolutions per minute). The yarn is then forced to twist between the final draw rollers and the spindle top. The twist is imparted by the rotation of the spindle top as the yarn is held in a yarn-catching means on top of the spindle top. The yarn then encounters a traveler, after which it is wound onto a bobbin.

It is necessary to wind the fully twisted yarn onto the bobbin at a tension which is higher than the drawn, untwisted roving's breaking tension. Prior art spindle tops will allow a relatively high tension created by the use of a relatively heavy traveler to propagate upstream, resulting in threadline breaks immediately downstream of the final draw rollers. The improved spindle top of the present invention permits the winding of yarn onto the bobbin at substantially higher tensions than are operable with prior art spindle tops, as the improved spindle top of the present invention does not allow tension to propagate upstream as easily as prior art spindle tops do. Higher winding tensions will in turn allow the production of greater package density, which reduces the frequency of doffing. Additionally, the improved spindle top reduces "ends down", as described below.

As described above, a spindle top is utilized in the yarn spinning process. The spindle top holds spun yarn on one of several "catch points". The final draw rolls are positioned above the spindle top, and drawn sliver or roving emerges from these draw rolls. During the yarn spinning process, twist is applied to the emerging drawn sliver or roving until the twist gets high enough that the spun yarn literally "rolls" out of the "catch point" it is in on the spindle top. Shortly after the yarn rolls out of one catch point, it enters another catch point. However, when the yarn "rolls" from one catch point to another, the yarn undergoes large changes in tension level. A high tension level is created by the yarn being "snagged" on a new catch point. This surge in tension can, and does occasionally, travel upstream enough to cause a threadline break as the roving emerges from the draw rolls. With the improved spindle top of the present invention, the tension surge is lowered, resulting in fewer ends down in the yarn spinning process.

The present invention pertains to an improved spindle top to be utilized in a process for forming a spun yarn. The improved spindle top has between 3 and 8 fingers positioned on the uppermost section of the spindle top, with the fingers having a longitudinal height between 10 and 30 millimeters. Each of the fingers has a yarn-catching surface which is substantially parallel to the axis of the spindle top. The fingers are positioned within a volume extending above a lower section of the spindle top. The improved spindle top also has a yarn-catching, yarn-directing groove in association with each of the fingers, each of these grooves having a length of at least 2.5 inches. Each of the grooves is oriented in a following helical orientation, each of the grooves making at least 0.25 revolutions around the spindle top, and each of the grooves has a yarn-catching section and a yarn-guiding section. The yarn-catching section of the groove originates at the top of its assocaited finger, at an uppermost position on the spindle top. The yarn-catching section progresses downward along an axis which is both substantially parallel to the plane of the yarn-contact surface on its associated finger and then turns at an angle between 45° and 75° to the axis of the spindle top. The yarn-catching section turns along a course which extends both below and downstrem of its associated finger, the yarn-catching section of each of the grooves becoming a yarn-directing section at a point at which the groove extends both below and behind its associated finger. A combination of each of the yarn-catching walls and their associated yarn-catching sections forms an effective yarn-catching surface having a height between 0.140 inches and 0.200 inches. The yarn-catching section of the wall forms a minimum undercut of between 0.001 inches and 0.006 inches.

It is an object of the present invention to increase the package density obtainable in a ring spinning operation.

It is a further object of the present invention to decrease the frequency of threadline breakage in a ring spinning operation.

It is a further object of the present invention to reduce the amount of manual labor necessary for doffing and donning operations in a ring spinning process.

It is a further object of the present invention to allow one to wind a spun yarn onto a bobbin under relatively high tension without allowing enough of that tension to propagate upstream so that the drawn sliver will be broken.

It is a further object of the present invention to reduce the maximum tension occurring between the spindle top and the last draw roll as the yarn "jumps" from one catch point to another on the spindle top.

It is a further object of the present invention to allow the use of a heavier traveler in a ring spinning process.

DETAILED DESCRIPTION OF THE PREFERRED EMBODIMENTS

The improved spindle top of the present invention is comprised of several critically-sized and critically-positioned elements which together create numerous advantages in the commercial practice of ring spinning. These advantages result in higher efficiency of production, i.e. more product per machine position and less manual labor per pound of product.

Figure 6:
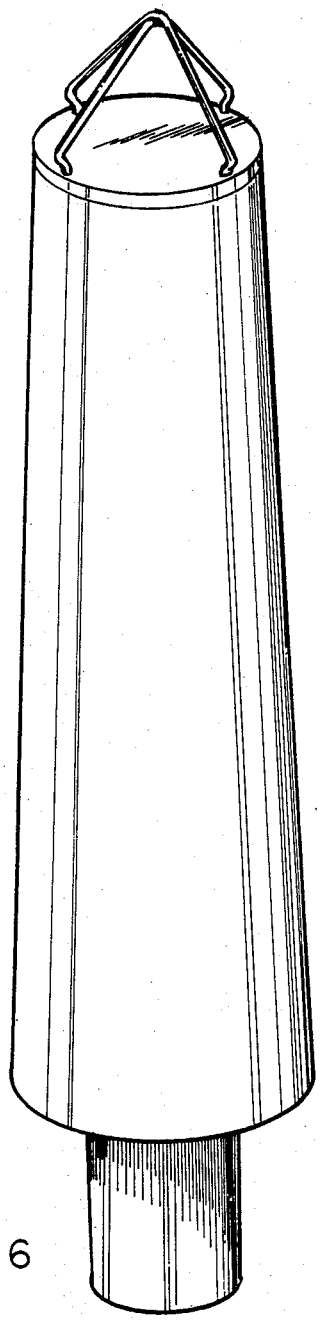
FIG. 6 is a perspective view of a prior art spindle top.
Figure 1:
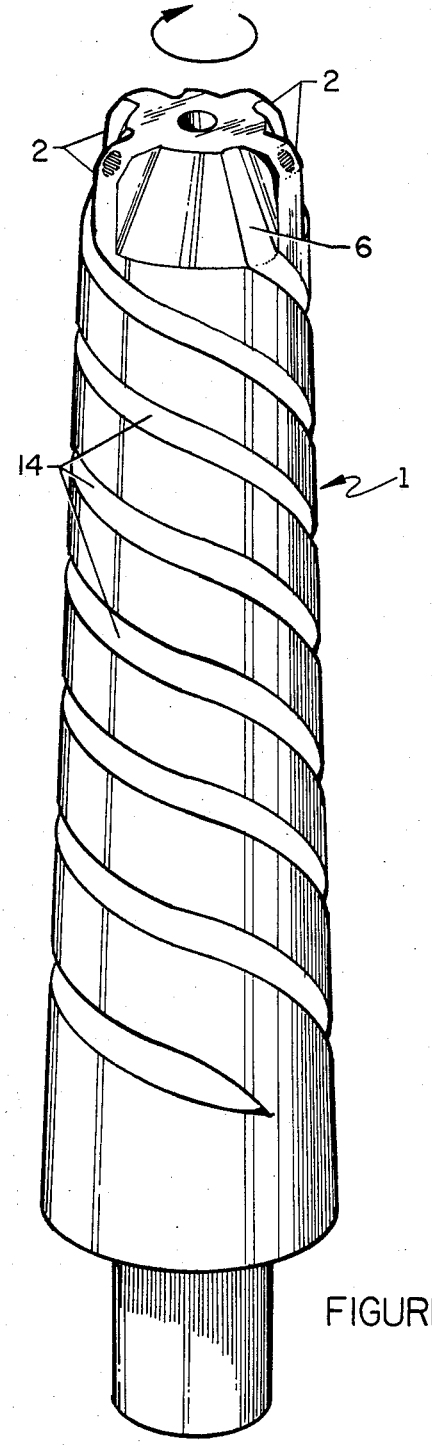
FIG. 1 illustrates a perspective view of a preferred embodiment of the spindle top of the present invention.

FIG. 1 illustrates a perspective view of a preferred embodiment of the spindle top (1) of the present invention. The spindle top (1) most preferably comprises four "fingers" (2) which are used to catch and hold a yarn (not shown). Most preferably, the spindle top (1) also comprises four helical yarn-catching, yarn-directing grooves, one groove being associated with each of the fingers (2). The circular arrow above the top (1) indictes the direction of revolution of the top during its operation. The grooves are oriented in a "following helical orientation" with respect to the direction of rotation of the spindle top. In other words, if one views the spindle top (1) from above, the spindle top (1) is rotating clockwise and the grooves would appear to trail behind the fingers during rotation. If the spindle top (1) is upright and in a fixed and still position, one moving along a point in a groove (from a "high" point to a "low" point along the main axis of top 1 would be moving in a counter-clockwise rotation when viewed from above. Most preferably, the helix angle of the grooves increases very slightly upon moving from high to low along the main axis of the top (1), as shown in FIG. 1. The spindle top (1) has a main yarn contact surface (12). The main yarn contact surface (12) has a generally conical shape and has a smallest diameter at its uppermost end.

Figure 2:
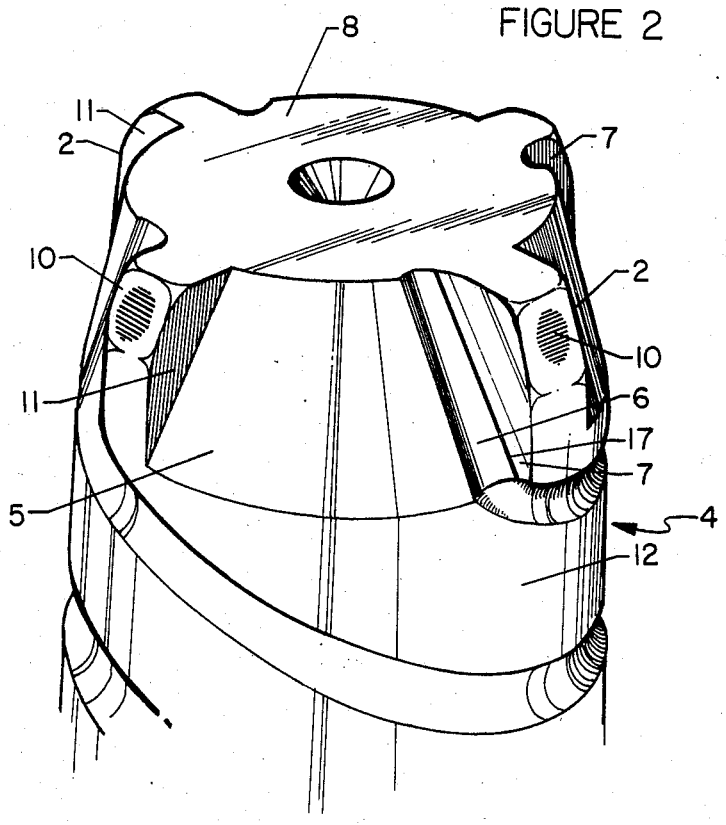
FIG. 2 illustrates an enlarged, sectional, perspective view of the upper section of the spindle top illustrated in FIG. 1.

FIG. 2 illustrates a perspective, enlarged view of the upper section (4) of the spindle top. The upper section (4) is comprised of main bevel surfaces (5), yarn-catching groove sections (6), a top surface (8), a portion of the main conical surface (12), substantially planar yarn-catching walls (7) of fingers (2), finger bevel surfaces (10) on fingers (2) and rear finger surfaces (11) on fingers (2).

Figure 4:
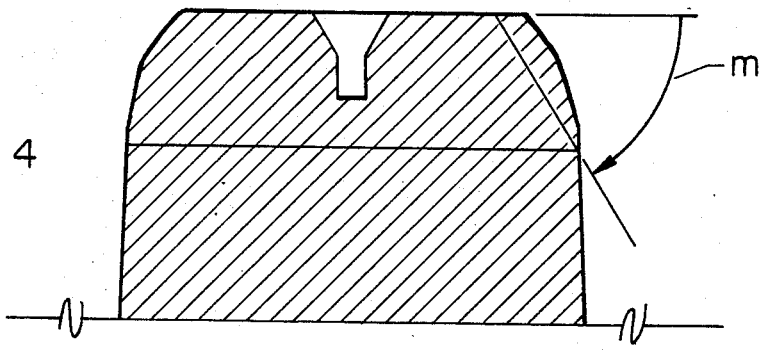
FIG. 4 is a longitudinal, cross-sectional view of the upper section of the spindle top illustrated in FIG. 1 along with diagrammatical lines which are used to define angles.

The beveled main surfaces (5) serve to create depressions which the yarn initially drops into as the yarn "rolls" from finger to finger during the ring spinning operation. It has been conceived that angle m (shown in FIG. 4), which the beveled main surface creates with the top surface (8), may vary from 45° to 75°. In the most preferred embodiment, this angle m is approximately 60°.

Figure 3:
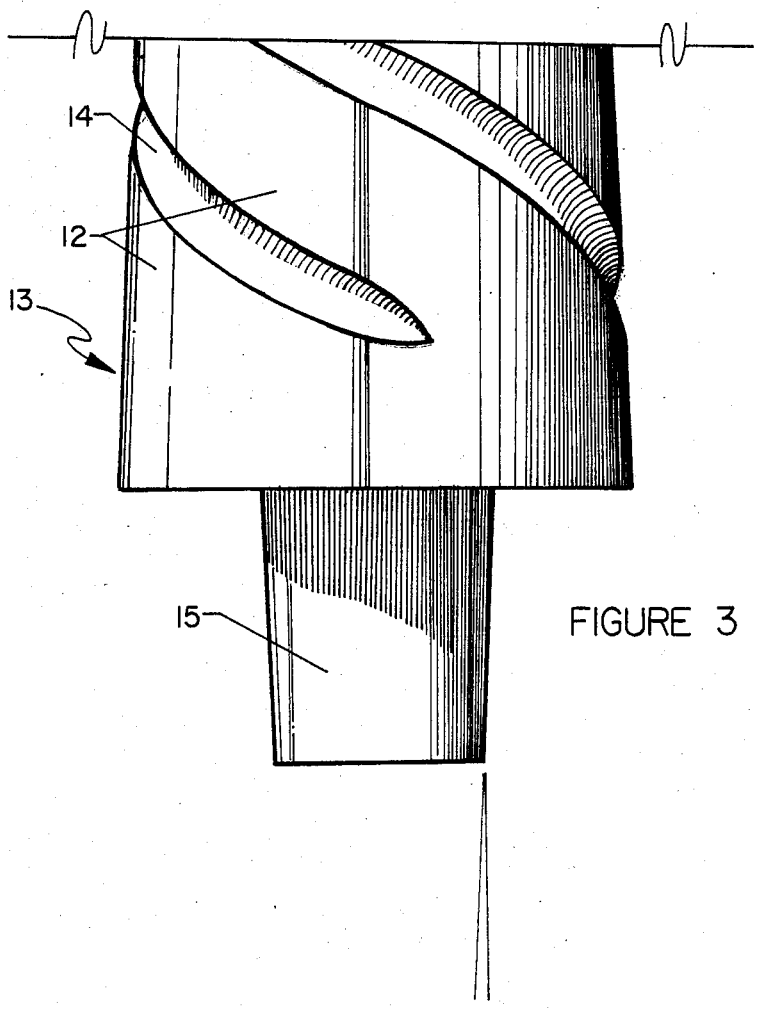
FIG. 3 illustrates a sectional, perspective view of the lower section of the spindle top illustrated in FIG. 1.

FIG. 3 illustrates, in perspective view, the lower section (13) of the spindle top (1). The lower section (13) comprises the majority of the main conical surface (12) and yarn-directing sections (14) of grooves (3). The lower section (13) also comprises a tapered plug portion (15) which fits into a spindle shaft (not shown).

Figure 5:
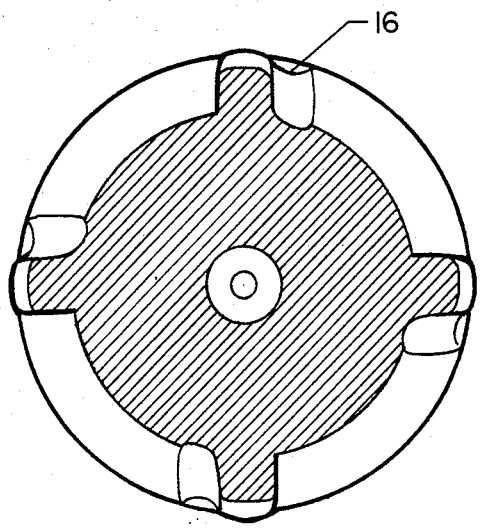
FIG. 5 is a cross-sectional view of the spindle top, this view being taken on a cross-section which is perpindicular to the axis of one of the "straight" portions of the yarn catching section (i.e. that portion of the groove which runs vertically and alongside the finger).

FIG. 5 is a cross-sectional view of the top portion of the spindle (1), this view being taken on a cross-section which is parallel to the top surface (8). This cross-sectional view shows that a "yarn catching wall" is present and is comprised of a substantially planar (shown slightly convex) yarn-catchng surface (7) in combination with a portion of the surface of the yarn-catching groove section (6). For a spindle top which rotates clockwise when viewed from above, as is the spindle top shown in FIGS. 1 through 5, the yarn-catching groove section (6) is always positioned slightly "clockwise" of its associated yarn-catching wall (7). The yarn-catching sections (6) of the grooves actually create a slight "undercut" which is critical in holding the yarn against the yarn-catching wall. A slight "line" (17), as shown in FIG. 2 is formed at the cross-sectional inflection point between the slightly concave yarn-catching wall (7) and the concave yarn-catching section of the groove (6). As stated above, the "substantially planar" yarn-catching wall (7), although close to being planar, is most preferably slightly concave, as shown in FIG. 5. It has been conceived that a planar yarn-catching wall (7) would be operable in the present invention. The amount of "undercut" necessary for the yarn-catching wall (7) has been conceived to be between 1 and 10 thousandths of an inch.

There are many parameters which have been conceived to be of importance in the operability of the present invention, as are described in detail below.

It is most preferred that the spindle top of the present invention has 4 fingers (2) thereon. However, it has been conceived that the spindle top of the present invention may have between 3 and 8 fingers thereon. It is preferred that the spindle top have between 4 and 6 fingers thereon (inclusive), and it is more preferred that the spindle top have either 4 or 5 fingers thereon. It is most preferred that the spindle top have 4 fingers thereon.

It has also been conceived that the fingers should have a longitudinal height H (shown in FIG. 4) of between 10 and 30 millimeters, and it is preferred that the longitudinal height is between 12 and 25 millimeters, and it is still more preferred that the fingers have a height between 12 and 18 millimeters. It is most preferred that the fingers have a longitudinal height of approximately 15 millimeters.

Each of the fingers has a yarn-catching, yarn-directing groove in association therewith. It has been conceived that each of the grooves must have a length of at least 2.25 inches, and it is preferred that each groove have a length between 2.25 and 18 inches. It is more preferred that the grooves have a length between 9 inches and 15 inches, and it is most preferred that the grooves have a length of approximately 12 inches. It has been conceived that the yarn-catching, yarn-directing grooves must make at least 0.25 revolutions around the axis of the spindle top, and it is preferred that each of the grooves makes between 1 and 3 revolutions around the axis of the spindle top. It is more preferred that each of the grooves makes between 1.5 and 2.5 revolutions around the axis of the spindle top, and it is most preferred that each of the grooves makes approximately 2.0 revolutions around the axis of the spindle top. It has also been conceived that the yarn-catching section of the groove should progress downward along an axis which is substantially parallel to the plane of the yarn-catching surface on its associated finger, and that the yarn-catching sections should then turn at an angle between 99° and 129° to the axis of the spindle top, the yarn catching sections turning along a course which extends both below and downstream of their associated figures. It is preferred that the yarn-catching section progress downward along an axis which is substantially parallel to the plane of the yarn-catching wall on its associated finger and that the yarn-catching section then turn at an angle between 104° and 124° to the axis of the spindle top. It is even more preferred that the yarn-catching section turn at an angle between 109° and 119° , and it is most preferred that the yarn-catching section turn at an angle of approximately 114°.

The combination of the yarn-catching section of the groove and the yarn-catching wall of its corresponding finger forms a yarn-catching surface. It has been conceived that the yarn-catching surface must have a height between 0.140 inches and 0.200 inches, and it is preferred that this height is between 0.160 inches and 0.180 inches. It is more preferred that the height of the yarn-catching wall is between 0.165 inches and 0.175 inches, and it is most preferred that the height of the yarn-catching wall is approximately 0.160 inches.

It is believed that the yarn-catching wall must provide a yarn-holding "undercut" - i.e. the yarn-catching surface cannot be absolutely planar. It is conceived that this undercut should measure between 0.001 inches and 0.010 inches, and it is preferred that this undercut measures between 0.001 inches and 0.006 inches. It is even more preferred that this undercut measure between 0.002 inches and 0.004 inches, and it is most preferred that this undercut measure approximately 0.003 inches It has been conceived that the width of the yarn-directing sections of the grooves is between 1 mm and 10 mm. It is preferred that the width of the yarn-directing sections is between 2 mm and 8 mm and it is more preferred that the width of the grooves is between 3 mm and 6 mm. Furthermore, it has been conceived that the yarn-directing sections of the groove may have a depth between 0.25 mm and 10 mm, and it is preferred that these sections of the grooves have a depth between 1 mm and 5 mm, and it is more preferred that these sections of the grooves have a depth between 2 mm and 3 mm. It is most preferred that the yarn directing sections of the grooves have a depth of substantially 2.5 mm.

It has been found that it is preferable to have the spindle top made from steel. It is also preferred, for frictional and wear characteristics, to have the spindle top chrome plated.

I claim:

1. An improved spindle top to be utilized in a process for forming a spun yarn, the improved spindle top comprising:

(a) between 3 and 8 fingers, the fingers having a longitudinal height between 10 and 30 millimeters, the fingers being positioned on an upper section of the spindle top, the fingers providing a substantially planar yarn-catching surface which is substantially parallel to the axis of the spindle top, the fingers being positioned substantially within the volume extending above a lower section of the spindle top; and (b) a yarn-catching, yarn directing groove in association with each of the fingers, each of the grooves having a total length of at least 2.25 inches, each of the grooves being oriented in a following helical orientation with respect to the direction of rotation of the spindle top, each of the grooves making at least 0.25 revolutions around the axis of the spindle top, each of the grooves having a yarn-catching section and a yarn-directing section, the yarn-catching section originating both immediately upstream of its associated finger and at an uppermost position on the spindle top, each of the yarn-catching sections progressing downward along an axis which is substantially parallel to the plane of the yarn-catching surfaces on the associated finger and each yarn-catching section then turning at an angle between 99° and 129° to the main axis of the spindle top, the yarn-catching sections turning along a course which extends both below and downstream of its associated finger, each of the yarn-catching sections becoming a yarn-directing section at a point at which the groove extends both below and behind its associated finger, a combination of each of the yarn-catching walls and their associated yarn-catching sections forming yarn-catching surfaces, the yarn catching surfaces having a height of between 0.140 inches and 0.200 inches, the yarn-catching section of the yarn-catching surface providing a yarn-catching undercut of up to 0.010 inches.

2. An improved spindle top as described in claim 1 wherein the improved spindle top comprises between 4 and 6 fingers, each finger having a longitudinal height of between 12 millimeters and 25 millimeters, the grooves in the top having a length between 2.25 inches and 18 inches, the grooves making between 1 and 3 revolutions around the spindle top, the yarn-catching sections of the grooves progressing downward along an axis which is substantially parallel to the plane of the yarn-contact surfaces on their associated fingers, the yarn-catching sections of the grooves then turning at an angle between 104° and 124° to the axis of the spindle top, the yarn catching surfaces having a height of between 0.160 inches and 0.180 inches, the yarn-catching section of the yarn-catching surface forming an undercut of up to 0.006 inches.

3. An improved spindle top as described in claim 2 wherein the spindle top is chrome plated.

4. An improved spindle top as described in claim 2 wherein a main yarn contact surface has a generally conical shape and has a smallest diameter at its uppermost end.

5. An improved spindle top as described in claim 2 wherein the yarn-directing section of each of the grooves has a width between 2 millimeters and 8 millimeters and a depth between 1 millimeter and 5 millimeters.

6. An improved spindle top as described in claim 1 wherein the improved spindle top comprises between 4 and 5 fingers, each finger having a longitudinal height of between 12 and 18 millimeters, the grooves in the top having a length between 9 inches and 15 inches, the grooves making between 1.5 and 2.5 revolutions around the spindle top, the yarn-catching sections of the grooves progressing downward along an axis which is substantially parallel to the plane of the yarn-contact surfaces on their associated fingers at an angle between 109° and 119° to the axis of the spindle top, the yarn catching surfaces having a height between 0.165 and 0.175 inches, the yarn-catching section of the yarn-catching surface forming an undercut of up to 0.004 inches.

7. An improved spindle top as described in claim 6 wherein the spindle top is chrome plated.

8. An improved spindle top as described in claim 7 wherein the spindle top has four fingers theron, and a main yarn contact surface has a generally conical shape and has a smallest diameter at its uppermost end, and the yarn-directing section of each of the grooves has a width of approximately 5 millimeters and a depth of 2.5 millimeters, and each groove has a length of about 12 inches, each groove making approximately 2 revolutions around the axis of the spindle top, and each yarn-catching section of each of the grooves forms at an angle of approximately 114°, each of the yarn catching surfaces having a height of approximately 0.170 inches and each of the yarn catching sections of each of the yarn-catching surfaces forming an undercut of up to 0.002 inches.

9. An improved spindle top as described in claim 6 wherein a main yarn contact surface has a generally conical shape and has a smallest diameter at its uppermost end.

10. An improved spindle top as described in claim 6 wherein the yarn-directing section of each of the grooves has a width between 3 and 6 millimeters and a depth between 2 and 3 millimeters.

11. An improved spindle top as described in claim 1 wherein the spindle top is chrome plated.

12. An improved spindle top as described in claim 1 wherein a main yarn contact surface has a generally conical shape and has a smallest diameter at its uppermost end.

13. An improved spindle top as described in claim 1 wherein the yarn-directing section of each of the grooves has a width between 1 millimeter and 10 millimeters and a depth between 0.25 millimeters and 10 millimeters.

* * * * *